US009689096B2

(12) United States Patent
Berrigan et al.

(10) Patent No.: US 9,689,096 B2
(45) Date of Patent: Jun. 27, 2017

(54) COMPOSITE NON-WOVEN FIBROUS WEBS HAVING CONTINUOUS PARTICULATE PHASE AND METHODS OF MAKING AND USING THE SAME

(75) Inventors: Michael R. Berrigan, Oakdale, MN (US); Eric M. Moore, Roseville, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 844 days.

(21) Appl. No.: 12/810,859

(22) PCT Filed: Dec. 15, 2008

(86) PCT No.: PCT/US2008/086770
§ 371 (c)(1),
(2), (4) Date: Jun. 28, 2010

(87) PCT Pub. No.: WO2009/088648
PCT Pub. Date: Jul. 16, 2009

(65) Prior Publication Data

US 2010/0291213 A1 Nov. 18, 2010

Related U.S. Application Data

(60) Provisional application No. 61/017,842, filed on Dec. 31, 2007.

(51) Int. Cl.
*A61K 9/00* (2006.01)
*D04H 1/42* (2012.01)
(Continued)

(52) U.S. Cl.
CPC ..... *D04H 1/42* (2013.01); *D04H 1/407* (2013.01); *D04H 1/413* (2013.01);
(Continued)

(58) Field of Classification Search
CPC .... B32B 5/00; B32B 5/02; B32B 5/16; B32B 2260/00; B32B 2260/04; B32B 2260/046;
(Continued)

(56) References Cited

U.S. PATENT DOCUMENTS 1,975,504 A 10/1934 Formhals
3,874,886 A 4/1975 Levecque et al.
(Continued)

FOREIGN PATENT DOCUMENTS

DE 199 29 709 12/2000
DE 10 2004 046 669 3/2006
(Continued)

OTHER PUBLICATIONS

Spunbond definition, Complete Textile Glossary, Celanese Acetate, © 2001.

*Primary Examiner* — Peter Y Choi
(74) *Attorney, Agent, or Firm* — James A. Baker

(57) ABSTRACT

The disclosure relates to composite nonwoven fibrous web including an embedded phase having a population of particulates forming a substantially continuous three-dimensional network, and a matrix phase comprising a population of fibers forming a three-dimensional network around the particulates. The disclosure also relates to methods of making a composite nonwoven fibrous web including forming an embedded phase having a population of particulates in a substantially continuous three-dimensional network, and forming a matrix phase comprising a population of fibers forming a three-dimensional network around the particulates. Articles made from a composite nonwoven fibrous web prepared according to the methods as described above are also disclosed. In exemplary embodiments, the articles may include gas filtration articles, liquid filtration articles, sound absorption articles, surface cleaning articles, cellular
(Continued)

growth support articles, drug delivery articles, personal hygiene articles, and wound dressing articles.

19 Claims, 4 Drawing Sheets

(51) Int. Cl.

| | |
|---|---|
| ***D04H 1/4382*** | (2012.01) |
| ***D04H 1/56*** | (2006.01) |
| ***D04H 1/407*** | (2012.01) |
| ***D04H 1/413*** | (2012.01) |
| ***D04H 1/4374*** | (2012.01) |
| ***D04H 1/559*** | (2012.01) |

(52) U.S. Cl.
CPC ..... *D04H 1/4374* (2013.01); *D04H 1/4382* (2013.01); *D04H 1/559* (2013.01); *D04H 1/56* (2013.01); *Y10T 428/249924* (2015.04); *Y10T 428/249926* (2015.04); *Y10T 442/30* (2015.04); *Y10T 442/40* (2015.04); *Y10T 442/60* (2015.04)

(58) Field of Classification Search
CPC ..... B32B 2264/00; B32B 2264/10; B32B 2555/00; B32B 2555/02; B01J 20/00; B01J 20/02
USPC ..... 442/380, 393, 181, 383
See application file for complete search history.

(56) References Cited

U.S. PATENT DOCUMENTS

| | | | | |
|---|---|---|---|---|
| 4,118,531 | A | 10/1978 | Hauser | |
| 4,127,706 | A | 11/1978 | Martin et al. | |
| 4,363,646 | A | 12/1982 | Torobin | |
| 4,536,361 | A | 8/1985 | Torobin | |
| 4,666,763 | A | 5/1987 | King et al. | |
| 4,729,371 | A | 3/1988 | Krueger et al. | |
| 5,227,107 | A | 7/1993 | Dickenson et al. | |
| 5,328,758 | A * | 7/1994 | Markell et al. | 442/351 |
| 5,332,426 | A | 7/1994 | Tang et al. | |
| 5,415,779 | A | 5/1995 | Markell et al. | |
| 5,496,507 | A | 3/1996 | Angadjivand et al. | |
| 5,605,746 | A | 2/1997 | Groeger et al. | |
| 5,855,788 | A | 1/1999 | Everhart et al. | |
| 5,871,836 | A * | 2/1999 | Schultink et al. | 428/181 |
| 6,057,256 | A | 5/2000 | Krueger et al. | |
| 6,114,017 | A | 9/2000 | Fabbricante et al. | |
| 6,139,308 | A * | 10/2000 | Berrigan et al. | 425/224 |
| 6,183,670 | B1 | 2/2001 | Torobin et al. | |
| 6,269,513 | B1 | 8/2001 | Torobin | |
| 6,315,806 | B1 | 11/2001 | Torobin et al. | |
| 6,382,526 | B1 | 5/2002 | Reneker et al. | |
| 6,391,429 | B1 * | 5/2002 | Senkus et al. | 428/198 |
| 6,494,974 | B2 | 12/2002 | Riddell | |
| 6,550,622 | B2 | 4/2003 | Koslow | |
| 6,607,624 | B2 | 8/2003 | Berrigan et al. | |
| 6,743,273 | B2 | 6/2004 | Chung et al. | |
| 6,800,226 | B1 | 10/2004 | Gerking | |
| 6,824,372 | B2 | 11/2004 | Berrigan et al. | |
| 6,861,025 | B2 | 3/2005 | Erickson et al. | |
| 6,872,311 | B2 | 3/2005 | Koslow | |
| 2001/0003082 | A1 | 6/2001 | kahlbaugh et al. | |
| 2002/0034624 | A1 | 3/2002 | Harpell et al. | |
| 2003/0216099 | A1 * | 11/2003 | Berrigan et al. | 442/409 |
| 2003/0224932 | A1 * | 12/2003 | Saaski et al. | 502/416 |
| 2004/0035095 | A1 | 2/2004 | Healey | |
| 2004/0092185 | A1 | 5/2004 | Grafe et al. | |
| 2004/0097155 | A1 | 5/2004 | Olson et al. | |
| 2005/0061728 | A1 | 3/2005 | Sprenger | |
| 2005/0079379 | A1 * | 4/2005 | Wadsworth et al. | 428/684 |
| 2005/0090173 | A1 | 4/2005 | Weisman | |
| 2005/0266760 | A1 | 12/2005 | Chhabra et al. | |
| 2005/0287891 | A1 | 12/2005 | Park | |
| 2006/0096910 | A1 | 5/2006 | Brownstein et al. | |
| 2006/0096911 | A1 | 5/2006 | Brey et al. | |
| 2006/0137317 | A1 | 6/2006 | Bryner et al. | |
| 2007/0175817 | A1 | 8/2007 | Goldman | |
| 2007/0202766 | A1 | 8/2007 | Ouellette et al. | |
| 2008/0026659 | A1 | 1/2008 | Brandner et al. | |
| 2008/0038976 | A1 | 2/2008 | Berrigan et al. | |

FOREIGN PATENT DOCUMENTS

| | | |
|---|---|---|
| JP | 2006-289209 | 10/2006 |
| WO | WO 93/06924 | 4/1993 |
| WO | WO 00/12194 | 3/2000 |
| WO | WO 00/29658 | 5/2000 |
| WO | WO 2004/046443 | 6/2004 |
| WO | WO 2006/089063 A2 | 8/2006 |
| WO | WO 2007/001990 | 1/2007 |
| WO | WO 2007/133903 | 11/2007 |
| WO | WO 2008/085545 | 7/2008 |

* cited by examiner

COMPOSITE NON-WOVEN FIBROUS WEBS HAVING CONTINUOUS PARTICULATE PHASE AND METHODS OF MAKING AND USING THE SAME

CROSS REFERENCE TO RELATED APPLICATION

This application claims the benefit of U.S. Provisional Patent Application No. 61/017,842, filed Dec. 31, 2007, the disclosure of which is incorporated by reference herein in its entirety.

TECHNICAL FIELD

The present disclosure relates to non-woven fibrous webs having at least one continuous particulate phase and methods of making and using such webs. The disclosure further relates to composite nonwoven fibrous webs, including sub-micrometer fibers and/or microfibers, useful in absorbent articles.

BACKGROUND

Nonwoven fibrous webs have been used to produce absorbent articles useful, for example, as absorbent wipes for surface cleaning, as gas and/or liquid absorbents for filtration media, and as barrier materials for sound and/or heat absorption. In some applications requiring high absorbency, it may be desirable to use a high porosity nonwoven web made up of high surface area fine fibers. For certain gas or liquid filtration applications, it may also be desirable to incorporate fine sorbent particulates into a web formed of fine nonwoven fibers. Fine fibers, however, have a tendency to collapse or crush in handling, thereby decreasing the porosity and/or surface area available for absorption, while increasing the pressure drop of a fluid passing through the nonwoven article. For gas and liquid filtration applications in particular, it may be desirable to maintain a low pressure drop through the nonwoven article even while maintaining high absorbency.

SUMMARY

There is an ongoing need to provide compact liquid filtration systems, for example, water filtration systems for home use. It is further desirable to minimize degradation of or damage to nonwoven fibrous webs useful as filtration media during processing to form liquid filtration articles. There is also a need to provide liquid filtration articles that have high loadings of active absorbent and/or adsorbent particulates without increasing pressure drop across the water filtration system. It is also be desirable to provide particulate-loaded nonwoven fibrous webs which effectively retain the particulates within the fiber matrix, thereby preventing release of particles into the permeating liquid. In addition, there is a continuing need to provide liquid filtration articles having improved service life and filtration effectiveness.

In one aspect, the disclosure relates to a composite nonwoven fibrous web comprising an embedded phase further comprising a population of particulates forming a substantially continuous three-dimensional network, and a matrix phase comprising a population of fibers forming a three-dimensional network around the particulates.

In another aspect, the disclosure relates to a method of making a composite nonwoven fibrous web comprising forming an embedded phase having a population of particulates in a substantially continuous three-dimensional network, and forming a matrix phase comprising a population of fibers forming a three-dimensional network around the particulates.

In an additional aspect, the disclosure relates to an article made from a composite nonwoven fibrous web prepared according to the method as described above. In exemplary embodiments, the article is selected from a gas filtration article, a liquid filtration article, a sound absorption article, a surface cleaning article, a cellular growth support article, a drug delivery article, a personal hygiene article, and a wound dressing article.

Exemplary embodiments of the composite nonwoven fibrous webs according to the present disclosure may have structural features that enable their use in a variety of applications; may have exceptional absorbent and/or adsorbent properties; may exhibit high porosity, high fluid permeability, and/or low pressure drop when used as a fluid filtration medium; and may be manufactured in a cost-effective and efficient manner.

Various aspects and advantages of exemplary embodiments of the disclosure have been summarized. The above Summary is not intended to describe each illustrated embodiment or every implementation of the present certain exemplary embodiments of the present invention. The Drawings and the Detailed Description that follow more particularly exemplify certain preferred embodiments using the principles disclosed herein.

BRIEF DESCRIPTION OF THE DRAWINGS

Exemplary embodiments of the present disclosure are further described with reference to the appended figures, wherein.

DETAILED DESCRIPTION

Glossary

Figure 1A:
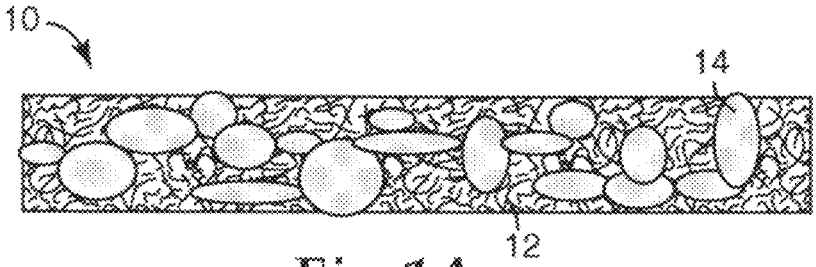
FIG. 1A is a schematic drawing of an illustrative single-layer composite nonwoven fibrous web comprising a substantially continuous particulate phase according to an exemplary embodiment of the disclosure.

As used herein:

"Microfibers means fibers having a median diameter of at least one micrometer.

"Ultrafine microfibers" means microfibers having a median diameter of two micrometers or less.

"Sub-micrometer fibers" means fibers having a median diameter of less than one micrometer.

When reference is made herein to a batch, group, array, etc. of a particular kind of microfiber, e.g., "an array of sub-micrometer fibers," it means the complete population of microfibers in that array, or the complete population of a single batch of microfibers, and not only that portion of the array or batch that is of sub-micrometer dimensions.

"Continuous oriented microfibers" means essentially continuous fibers issuing from a die and traveling through a processing station in which the fibers are permanently drawn and at least portions of the polymer molecules within the fibers are permanently oriented into alignment with the longitudinal axis of the fibers ("oriented" as used with respect to fibers means that at least portions of the polymer molecules of the fibers are aligned along the longitudinal axis of the fibers).

"Meltblown fibers" means fibers prepared by extruding molten fiber-forming material through orifices in a die into a high-velocity gaseous stream, where the extruded material is first attenuated and then solidifies as a mass of fibers.

"Separately prepared microfibers" means a stream of microfibers produced from a micromicrofiber-forming apparatus (e.g., a die) positioned such that the microfiber stream is initially spatially separate (e.g., over a distance of about 1 inch (25 mm) or more from, but will merge in flight and disperse into, a stream of larger size microfibers.

"Nonwoven web" means a fibrous web characterized by entanglement or point bonding of the fibers.

"Self-supporting" means a web having sufficient coherency and strength so as to be drapable and handleable without substantial tearing or rupture.

"Solidity" is defined by the equation:

$$\text{Solidity (\%)} = \frac{[3.937 * \text{Web Basis Weight (g/m}^2)]}{[\text{Web Thickness (mils)} * \text{Bulk Density (g/cm}^3)]}$$

"Web basis weight" is calculated from the weight of a 10 cm×10 cm web sample.

"Web thickness" is measured on a 10 cm×10 cm web sample using a thickness testing gauge having a tester foot with dimensions of 5 cm×12.5 cm at an applied pressure of 150 Pa.

"Bulk density" is the bulk density of the polymer or polymer blend that makes up the web, taken from the literature.

"Molecularly same polymer" means polymers that have essentially the same repeating molecular unit, but which may differ in molecular weight, method of manufacture, commercial form, and the like.

"Meltblowing" and "meltblown process" means a method for forming a nonwoven web by extruding a fiber-forming material through a plurality of orifices to form filaments while contacting the filaments with air or other attenuating fluid to attenuate the filaments into fibers and thereafter collecting a layer of the attenuated fibers.

"Attenuating the filaments into fibers" means the conversion of a segment of a filament into a segment of greater length and smaller diameter.

"Spunbonding" and "Spun bond process" means a method for forming a nonwoven web by extruding a low viscosity melt through a plurality of orifices to form filaments, quenching the filaments with air or other fluid to solidify at least the surfaces of the filaments, contacting the at least partially solidified filaments with air or other fluid to attenuate the filaments into fibers and collecting and optionally calendering a layer of the attenuated fibers.

"Spun bond fibers" means fibers made using a spun bond process. Such fibers are generally continuous and are entangled or point bonded sufficiently that it is usually not possible to remove one complete spun bond fiber from a mass of such fibers.

"Die" means a processing assembly for use in polymer melt processing and fiber extrusion processes, including but not limited to meltblowing and the spunbonding processes.

"Particle" and "particulate" are used substantially interchangeably. Generally, a particle or particulate means a small distinct piece or individual part of a material in finely divided form. However, a particulate may also include a collection of individual particles associated or clustered together in finely divided form. Thus, individual particles used in certain exemplary embodiments of the present disclosure may clump, physically intermesh, electro-statically associate, or otherwise associate to form particulates. In certain instances, particulates in the form of agglomerates of individual particles may be intentionally formed such as those described in U.S. Pat. No. 5,332,426 (Tang et al.).

"Particle-loaded meltblown media" or "composite nonwoven fibrous web" means a nonwoven web having an open-structured entangled mass of fibers, for example, sub-micrometer fibers and optionally microfibers, containing particles enmeshed among the fibers, the particles optionally being absorbent and/or adsorbent.

"Enmeshed" means that particles are distributed and physically held in the fibers of the web. Generally, there is point and line contact along the fibers and the particles so that nearly the full surface area of the particles is available for interaction with a fluid.

"Autogenous bonding" means bonding between fibers at an elevated temperature as obtained in an oven or with a through-air bonder without application of solid contact pressure such as in point-bonding or calendering.

"Calendering" means a process of passing a product, such as a polymeric absorbent loaded web through rollers to obtain a compressed material. The rollers may optionally be heated.

"Densification" means a process whereby fibers which have been deposited either directly or indirectly onto a filter winding arbor or mandrel are compressed, either before or after the deposition, and made to form an area, generally or locally, of lower porosity, whether by design or as an artifact of some process of handling the forming or formed filter. Densification also includes the process of calendering webs.

"Fluid treatment unit" or "fluid filtration system" means a system containing a filtration media and a method of separating raw fluid, such as untreated water, from treated fluid. This typically includes a filter housing for a filter element and an outlet to pass treated fluid away from the filter housing in an appropriate manner.

"Void volume" means a percentage or fractional value for the unfilled space within a porous body such as a filter, calculated by measuring the weight and volume of a filter, then comparing the filter weight to the theoretical weight a solid mass of the same constituent material of that same volume.

"Porosity" means a measure of void spaces in a material. Size, frequency, number, and/or interconnectivity of pores and voids contribute the porosity of a material.

"Layer" means a single stratum formed between two major surfaces. A layer may exist internally within a single web, e.g., a single stratum formed with multiple strata in a single web have first and second major surfaces defining the thickness of the web. A layer may also exist in a composite article comprising multiple webs, e.g., a single stratum in a first web having first and second major surfaces defining the thickness of the web, when that web is overlaid or underlaid by a second web having first and second major surfaces defining the thickness of the second web, in which case each of the first and second webs forms at least one layer. In addition, layers may simultaneously exist within a single web and between that web and one or more other webs, each web forming a layer.

"Adjoining" with reference to a particular first layer means joined with or attached to another, second layer, in a position wherein the first and second layers are either next to (i.e. adjacent to) and directly contacting each other, or contiguous with each other but not in direct contact (i.e. there are one or more additional layers intervening between the first and second layers).

"Particulate density gradient," "sorbent density gradient," and "fiber population density gradient" mean that the amount of particulate, sorbent or fibrous material within a particular fiber population (e.g., the number, weight or volume of a given material per unit volume over a defined area of the web) need not be uniform throughout the composite nonwoven fibrous web, and that it can vary to provide more material in certain areas of the web and less in other areas.

Various exemplary embodiments of the disclosure will now be described with particular reference to the Drawings. Exemplary embodiments of the certain exemplary embodiments of the present disclosure may take on various modifications and alterations without departing from the spirit and scope of the disclosure. Accordingly, it is to be understood that the embodiments of the present invention are not to be limited to the following described exemplary embodiments, but are to be controlled by the limitations set forth in the claims and any equivalents thereof.

A. Composite Nonwoven Fibrous Webs

In one aspect, the disclosure provides a composite nonwoven fibrous web comprising an embedded phase further comprising a population of particulates forming a substantially continuous three-dimensional network, and a matrix phase comprising a population of fibers forming a three-dimensional network around the particulates.

In one exemplary embodiment of the present disclosure, particulates are incorporated into a nonwoven fibrous web that comprises microfibers and/or sub-micrometer fibers, such that the particulates form a substantially continuous first phase distributed in a substantially continuous second phase comprising the microfibers and/or sub-micrometer fibers. The first and second phases are thus both substantially co-continuous.

In another exemplary embodiment of the present disclosure, sub-micrometer fibers are incorporated into a nonwoven fibrous web that comprises microfibers, such that the sub-micrometer fibers form a substantially continuous first phase distributed in a substantially continuous second phase comprising the microfibers. The first and second phases are thus both substantially co-continuous.

In an additional exemplary embodiment of the present disclosure, particulates and discontinuous (for example, staple) microfibers are incorporated into a nonwoven fibrous web that comprises microfibers and/or sub-micrometer fibers, such that the particulates and staple microfibers form a substantially continuous first phase distributed in a substantially continuous second phase comprising the microfibers and/or sub-micrometer fibers. The first and second phases are thus both substantially co-continuous.

Referring to FIG. 1A, a schematic drawing illustrating one exemplary embodiment of a composite nonwoven fibrous web according to the present disclosure is shown. A single-layer composite nonwoven fibrous web 10 is formed by an embedded phase comprising a population of particulates 14 in the form of fine particles forming a substantially continuous three-dimensional network, and a matrix phase comprising a population of fibers 12 forming a three-dimensional network around the particulates 14.

In the illustrated embodiment of FIG. 1A, the particulates 14 are shown as individual distinct particles in which each individual particle is in surface to surface contact with at least one other particle, forming an embedded phase that is made up of a substantially continuous three-dimensional network of individual particles (e.g., a chain of particles).

Although the individual particles in FIG. 1A are shown as solid particles having a non-uniform geometric shape, it will be understood that the population of particulates may include particles of any shape and/or construction. For example, some or all of the particles may have a uniform regular geometric shape (e.g., spherical, elliptical, polygonal, needle-like, and the like) or even an irregular shape. In addition, hollow or porous particles may be used.

Figure 1B:
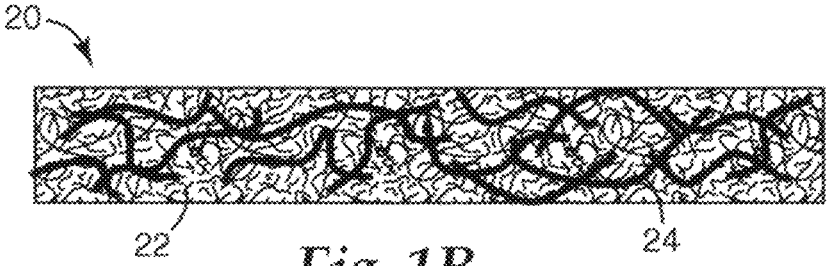
FIG. 1B is a schematic drawing of an illustrative single-layer composite nonwoven fibrous web comprising a substantially continuous particulate phase according to another exemplary embodiment of the disclosure.

In another exemplary embodiment illustrated in FIG. 1B, a single-layer composite nonwoven fibrous web 20 is formed by an embedded phase comprising a population of particulates 24 in the form of discontinuous fibers forming a substantially continuous three-dimensional network, and a matrix phase comprising a population of fibers 22 forming a three-dimensional network around the particulates 24. In the illustrated embodiment of FIG. 1B, the particulates 24 are shown as individual discontinuous fibers in which each individual discontinuous fiber is in surface to surface contact with at least one other discontinuous fiber, forming an embedded phase that is made up of a substantially continuous three-dimensional network of individual particles (e.g., a chain of individual discontinuous fibers).

Figure 1C:
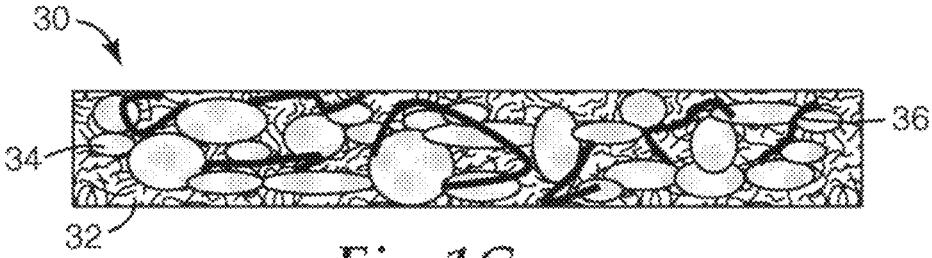
FIG. 1C is a schematic drawing of an illustrative single-layer composite nonwoven fibrous web comprising a substantially continuous particulate phase according to a further exemplary embodiment of the disclosure.

In another exemplary embodiment illustrated in FIG. 1C, a single-layer composite nonwoven fibrous web 30 is formed by an embedded phase comprising a population of particulates 34 in the form of individual particles bonded together with a plurality of discontinuous fibers 36, the particulates forming a substantially continuous three-dimensional network, and a matrix phase comprising a population of fibers 32 forming a three-dimensional network around the particulates 34.

In the illustrated embodiment of FIG. 1C, the particulates 34 are shown as individual distinct particles in which each individual particle is in surface to surface contact with at least one other particle, forming an embedded phase that is made up of a substantially continuous three-dimensional network of individual particles (e.g., a chain of particles). However, the individual particulates 34 need not be in surface to surface contact as shown, because at least a portion of the individual particulates 34 are held together by the plurality of discontinuous fibers 36, and each individual discontinuous fiber is in surface to surface contact with at least one other discontinuous fiber or another particulate, thereby forming an embedded phase that is made up of a substantially continuous three-dimensional network of individual particles (e.g., a chain of individual discontinuous fibers).

Furthermore, although the individual particles in FIG. 1C are shown as solid particles having a non-uniform geometric shape, it will be understood that the population of particulates may include particles of any shape and/or construction. For example, some or all of the particles may have a uniform regular geometric shape (e.g., spherical, elliptical, polygonal, needle-like, and the like) or even an irregular shape. In addition, hollow or porous particles may be used.

Figure 1D:
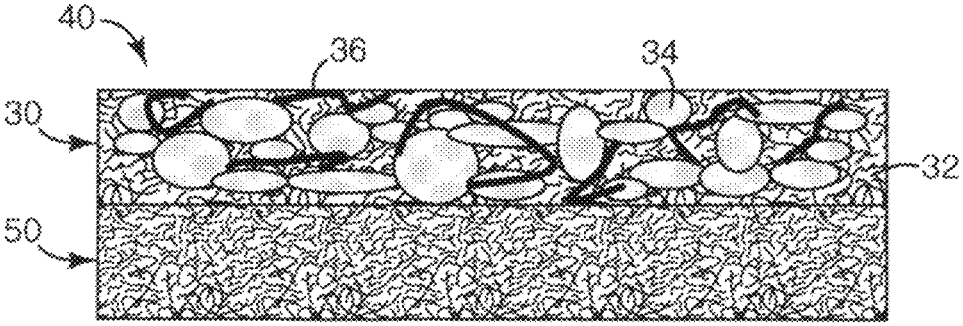
FIG. 1D is a schematic drawing of an illustrative multi-layer composite nonwoven fibrous web comprising a substantially continuous particulate phase according to an exemplary embodiment of the disclosure.

In another exemplary embodiment illustrated in FIG. 1D, a multi-layer composite nonwoven fibrous web is formed. The multi-layer composite nonwoven fibrous web 40 comprises a support layer 50. As shown in FIG. 1D, the support layer 50 may support the single-layer composite nonwoven fibrous web 30 shown in FIG. 1C, formed by an embedded phase comprising a population of particulates 34 in the form of individual particles bonded together with a plurality of discontinuous fibers 36, the particulates forming a substantially continuous three-dimensional network, and a matrix phase comprising a population of fibers 32 forming a three-dimensional network around the particulates 34. Alternatively, the optional support layer may be used to support the single layer composite nonwoven fibrous web 10 of FIG. 1A (not shown), or the single layer composite nonwoven fibrous web 20 of FIG. 1B (not shown).

Although a bi-layer construction is illustrated in FIG. 1D, it is to be understood that other multi-layer composite nonwoven fibrous web constructions are within the scope of the present disclosure. Thus, for example, multi-layer composite nonwoven fibrous web constructions comprising 3, 4, 5 or any number of layers, having any structure and/or composition, and arranged in any order, are within the scope of the present disclosure, provided that at least one layer comprises an embedded phase further comprising a population of particulates, the particulates forming a substantially continuous three-dimensional network, and a matrix phase comprising a population of fibers forming a three-dimensional network around the particulates.

It has been found that the matrix phase comprising a population of fibers may be formed by combining a stream of sub-micrometer fibers with a stream of microfibers, which in some exemplary embodiments may be a stream of very fine microfibers having a median diameter of one or two micrometers or less, whereupon the sub-micrometer fibers are captured by the stream of microfibers and dispersed among the microfibers. Such embodiments are within the scope of the present disclosure when combined with the disclosure of U.S. patent application Ser. No. 12/810,113.

Thus, in certain exemplary embodiments (not shown) within the scope of the above combined disclosures, at least a portion of the population of fibers comprising the matrix phase may comprise sub-micrometer fibers. In other exemplary embodiments, at least a portion of the population of fibers comprising the matrix phase comprises a population of sub-micrometer fibers, and the matrix phase further comprises a population of microfibers. In additional exemplary embodiments (not shown), the population of sub-micrometer fibers is formed with the population of microfibers. In other exemplary embodiments (not shown), at least a portion of the population of sub-micrometer fibers is formed separately from the population of microfibers. In some exemplary embodiments (not shown), the population of microfibers is compositionally the same as the population of sub-micrometer fibers.

In additional exemplary embodiments (not shown) within the scope of the above combined disclosures, the composite nonwoven fibrous web has a thickness, and a ratio of the number of sub-micrometer fibers to the number of microfibers varies across the thickness of the composite nonwoven fibrous web. In some exemplary embodiments (not shown), the ratio of the number of sub-micrometer fibers to the number of microfibers decreases across the thickness of the composite nonwoven fibrous web. In other exemplary embodiments (not shown), the ratio of the number of sub-micrometer fibers to the number of microfibers varies from a peak value proximate a centerline defined by the half-thickness of the composite nonwoven fibrous web, to a lower value at a surface of the composite nonwoven fibrous web.

Also, using certain exemplary embodiments of the combined disclosure as described above, the collected microfibers may be bonded, preferably by an autogenous thermal bonding step, to form a coherent matrix that is self-sustaining in which the microfibers are reliably held and protected so the web can be handled and used with minimal loss or crushing of microfibers. Preferably the microfibers are oriented fibers comprised of a semicrystalline polymeric material, thus adding to the mechanical or physical properties of the web.

Furthermore, in additional exemplary embodiments within the scope of the above combined disclosures, at least a portion of the particulates may be bonded to at least a portion of the population of fibers. In certain additional embodiments, at least a portion of the particulates may be bonded to at least a portion of the population of separately-formed fibers. In certain presently preferred embodiments, at least a portion of the particulates may be bonded to at least a portion of the population of microfibers.

For any of the exemplary embodiments of a composite nonwoven fibrous web according to the present disclosure, the web will exhibit a basis weight, which may be varied depending upon the particular end use of the web. Typically, the web has a basis weight of less than about 1000 grams per square meter (gsm). In some embodiments, the web has a basis weight of from about 1.0 gsm to about 500 gsm. In other embodiments, the web has a basis weight of from about 10 gsm to about 300 gsm.

As with the basis weight, the composite nonwoven fibrous web will exhibit a thickness, which may be varied depending upon the particular end use of the web. Typically, the web has a thickness of less than about 300 millimeters (mm). In some embodiments, the web has a thickness of from about 0.5 mm to about 150 mm. In other embodiments, the web has a thickness of from about 1.0 mm to about 50 mm.

In other exemplary embodiments, the composite nonwoven fibrous web may have a thickness and exhibits a Solidity of less than 10%. In particular, Applicant believes that it has not heretofore been known to control Solidity to less than 10% by controlling the ratio of the number of sub-micrometer fibers to the number of microfibers within a composite nonwoven fibrous web, in order to control the porosity and permeability of the resulting composite nonwoven fibrous web.

Various characteristics and components of exemplary composite nonwoven fibrous webs according to the present disclosure will now be described.

B. Composite Nonwoven Fibrous Web Components

Composite nonwoven fibrous webs of the present disclosure may comprise one or more of the following components:

1. Particulate Component

As noted above, exemplary composite nonwoven fibrous webs according to the present disclosure include an embedded phase comprising a population of particulates. Any suitable particulate material may be selected. Suitable particulates may have a variety of physical forms (e.g., solid particles, porous particles, hollow bubbles, agglomerates, discontinuous fibers, staple fibers, flakes, and the like); shapes (e.g., spherical, elliptical, polygonal, needle-like, and the like); shape uniformities (e.g., monodisperse, substantially uniform, non-uniform or irregular, and the like); composition (e.g., inorganic particulates, organic particulates, or combination thereof); and size (e.g., sub-micrometer-sized, micro-sized, and the like).

With particular reference to particulate size, in some exemplary embodiments, it may be desirable to control the size of a population of the particulates. In some exemplary embodiments, the particulates comprise a population of sub-micrometer-sized particulates having a population median diameter of less than one micrometer (μm), more preferably less than about 0.9 μm, even more preferably less than about 0.5 μm, most preferably less than about 0.25 μm. Such sub-micrometer-sized particulates may be particularly useful in applications where high surface area and/or high absorbency and/or adsorbent capacity is desired. In further exemplary embodiments, the population of sub-micrometer-sized particulates has a population median diameter of at least 0.001 μm, more preferably at least about 0.01 μm, most preferably at least about 0.1 μm, most preferably at least about 0.2 μm.

In further exemplary embodiments, the particulates comprise a population of micro-sized particulates having a population median diameter of at most about 2,000 μm, more preferably at most about 1,000 μm, most preferably at most about 500 μm. In other exemplary embodiments, the particulates comprise a population of micro-sized particulates having a population median diameter of at most about 10 μm, more preferably at most about 5 μm, even more preferably at most about 2 μm. In certain exemplary embodiments, the particulates may comprise discontinuous fibers having a median diameter as described above.

Multiple types of particulates may also be used within a single finished web. Using multiple types of particulates, it may be possible to generate continuous particulate webs even if one of the particulate types does not bond with other particles of the same type. An example of this type of system would be one where two types are particles are used, one that bonds the particulates together (e.g., a discontinuous polymeric fiber particulate) and another that acts as an active particle for the desired purpose of the web (e.g., a sorbent particulate such as activated carbon). Such exemplary embodiments may be particularly useful for fluid filtration applications.

In certain such exemplary embodiments, it may be advantageous to use at least one particulate that has a surface that can be made adhesive or "sticky" so as to bond together the particulates to form a mesh or support matrix for the fiber component. In this regard, useful particulates may comprise a polymer, for example, a thermoplastic polymer, which may be in the form of discontinuous fibers. Suitable polymers include polyolefins, particularly thermoplastic polyolefinic elastomers (TPE's, e.g., VISTMAXX™, available from Exxon-Mobil Chemical Company, Houston, Tex.). In further exemplary embodiments, particulates comprising a TPE, particularly as a surface layer or surface coating, may be preferred, as TPE's are generally somewhat tacky, which may assist bonding together of the particulates to form a three-dimensional network before addition of the fibers to form the composite nonwoven fibrous web. In certain exemplary embodiments, particulates comprising a VISTMAXX™ TPE may offer improved resistance to harsh chemical environments, particularly at low pH (e.g., pH no greater than about 3) and high pH (e.g., pH of at least about 9) and in organic solvents.

In additional exemplary embodiments, it may be advantageous to use at least one sorbent particulate, for example, an absorbent, an adsorbent, activated carbon, an anion exchange resin, a cation exchange resin, a molecular sieve, or a combination thereof. A variety of sorbent particles can be employed. Desirably the sorbent particles will be capable of absorbing or adsorbing gases, aerosols or liquids expected to be present under the intended use conditions.

The sorbent particles can be in any usable form including beads, flakes, granules or agglomerates. Preferred sorbent particles include activated carbon; alumina and other metal oxides; sodium bicarbonate; metal particles (e.g., silver particles) that can remove a component from a fluid by adsorption, chemical reaction, or amalgamation; particulate catalytic agents such as hopcalite (which can catalyze the oxidation of carbon monoxide); clay and other minerals treated with acidic solutions such as acetic acid or alkaline solutions such as aqueous sodium hydroxide; ion exchange resins; molecular sieves and other zeolites; silica; biocides; fungicides and virucides. Activated carbon and alumina are particularly preferred sorbent particles. Mixtures of sorbent particles can also be employed, e.g., to absorb mixtures of gases, although in practice to deal with mixtures of gases it may be better to fabricate a multilayer sheet article employing separate sorbent particles in the individual layers.

The desired sorbent particle size can vary a great deal and usually will be chosen based in part on the intended service conditions. As a general guide, the sorbent particles may vary in size from about 0.001 to about 3000 μm median diameter. Preferably the sorbent particles are from about 0.01 to about 1500 μm median diameter, more preferably from about 0.02 to about 750 μm median diameter, and most preferably from about 0.05 to about 300 μm median diameter. In certain exemplary embodiments, the sorbent particles may comprise nanoparticulates having a population median diameter less than 1 μm. Porous nanoparticulates may have the advantage of providing high surface area for sorption of contaminants from a fluid medium (e.g. absorption and/or adsorption).

Mixtures (e.g., bimodal mixtures) of sorbent particles having different size ranges can also be employed, although in practice it may be better to fabricate a multilayer sheet article employing larger sorbent particles in an upstream layer and smaller sorbent particles in a downstream layer. At least 80 weight percent sorbent particles, more preferably at least 84 weight percent and most preferably at least 90 weight percent sorbent particles are enmeshed in the web. Expressed in terms of the web basis weight, the sorbent particle loading level may for example be at least about 500 gsm for relatively fine (e.g. sub-micrometer-sized) sorbent particles, and at least about 2,000 gsm for relatively coarse (e.g., micro-sized) sorbent particles.

2. Fiber Component

As noted above, exemplary composite nonwoven fibrous webs according to the present disclosure include a matrix phase comprising a population of fibers forming a three-dimensional network around the particulates. Suitable fiber populations may comprise sub-micrometer fibers, microfibers, ultrafine microfibers, or a combination thereof.

In certain exemplary embodiments, the population of fibers may be oriented. Oriented fibers are fibers where there is molecular orientation within the fiber. Fully oriented and partially oriented polymeric fibers are known and commercially available. Orientation of fibers can be measured in a number of ways, including birefringence, heat shrinkage, X-ray scattering, and elastic modulus (see e.g., *Principles of Polymer Processing*, Zehev Tadmor and Costas Gogos, John Wiley and Sons, New York, 1979, pp. 77-84).

It is important to note that molecular orientation is distinct from crystallinity, as both crystalline and amorphous materials can exhibit molecular orientation independent from crystallization. Thus, even though commercially known sub-micrometer fibers made by melt-blowing or electrospinning are not oriented, there are known methods of imparting molecular orientation to fibers made using those processes. However, the process described by Torobin (see, e.g., U.S. Pat. No. 4,536,361) has not been shown to produce molecularly oriented fibers.

a. Sub-Micrometer Fibers

The composite nonwoven fibrous webs of the present disclosure may comprise one or more fine sub-micrometer fiber components. In some embodiments, a preferred fine sub-micrometer fiber component is a sub-micrometer fiber component comprising fibers having a median fiber diameter of less than one micrometer (μm). In some exemplary embodiments, the sub-micrometer fiber component comprises fibers have a median fiber diameter ranging from about 0.2 μm to about 0.9 μm. In other exemplary embodiments, the sub-micrometer fiber component comprises fibers have a median fiber diameter ranging from about 0.5 μm to about 0.7 μm.

In the present disclosure, the "median fiber diameter" of fibers in a given sub-micrometer fiber component is determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 50, and desirably ranges from about 50 to about 200.

In some exemplary embodiments, the sub-micrometer fiber component may comprise one or more polymeric materials. Suitable polymeric materials include, but are not limited to, polyolefins such as polypropylene and polyethylene; polyesters such as polyethylene terephthalate and polybutylene terephthalate; polyamide (Nylon-6 and Nylon-6,6); polyurethanes; polybutene; polylactic acids; polyvinyl alcohol; polyphenylene sulfide; polysulfone; liquid crystalline polymers; polyethylene-co-vinylacetate; polyacrylonitrile; cyclic polyolefins; polyoxymethylene; polyolefinic thermoplastic elastomers; or a combination thereof.

The sub-micrometer fiber component may comprise monocomponent fibers comprising any one of the above-mentioned polymers or copolymers. In this exemplary embodiment, the monocomponent fibers may contain additives as described below, but comprise a single fiber-forming material selected from the above-described polymeric materials. Further, in this exemplary embodiment, the monocomponent fibers typically comprise at least 75 weight percent of any one of the above-described polymeric materials with up to 25 weight percent of one or more additives. Desirably, the monocomponent fibers comprise at least 80 weight percent, more desirably at least 85 weight percent, at least 90 weight percent, at least 95 weight percent, and as much as 100 weight percent of any one of the above-described polymeric materials, wherein all weights are based on a total weight of the fiber.

The sub-micrometer fiber component may also comprise multi-component fibers formed from (1) two or more of the above-described polymeric materials and (2) one or more additives as described below. As used herein, the term "multi-component fiber" is used to refer to a fiber formed from two or more polymeric materials. Suitable multi-component fiber configurations include, but are not limited to, a sheath-core configuration, a side-by-side configuration, and an "islands-in-the-sea" configuration.

For sub-micrometer fiber components formed from multi-component fibers, desirably the multi-component fiber comprises (1) from about 75 to about 99 weight percent of two or more of the above-described polymers and (2) from about 25 to about 1 weight percent of one or more additional fiber-forming materials based on the total weight of the fiber.

b. Microfibers

The composite nonwoven fibrous webs of the present disclosure may comprise one or more coarse fiber components such as a microfiber component. In some embodiments, a preferred coarse fiber component is a microfiber component comprising fibers having a median fiber diameter of at least 1 μm. In some exemplary embodiments, the microfiber component comprises fibers have a median fiber diameter ranging from about 2 μm to about 100 μm. In other exemplary embodiments, the microfiber component comprises fibers have a median fiber diameter ranging from about 5 μm to about 50 μm.

In the present disclosure, the "median fiber diameter" of fibers in a given microfiber component is determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 50, and desirably ranges from about 50 to about 200.

In some exemplary embodiments, the microfiber component may comprise one or more polymeric materials. Generally, any fiber-forming polymeric material may be used in preparing the microfiber, though usually and preferably the fiber-forming material is semi-crystalline. The polymers commonly used in fiber formation, such as polyethylene, polypropylene, polyethylene terephthalate, nylon, and urethanes, are especially useful. Webs have also been prepared from amorphous polymers such as polystyrene. The specific polymers listed here are examples only, and a wide variety of other polymeric or fiber-forming materials are useful.

Suitable polymeric materials include, but are not limited to, polyolefins such as polypropylene and polyethylene; polyesters such as polyethylene terephthalate and polybutylene terephthalate; polyamide (Nylon-6 and Nylon-6,6); polyurethanes; polybutene; polylactic acids; polyvinyl alcohol; polyphenylene sulfide; polysulfone; liquid crystalline polymers; polyethylene-co-vinylacetate; polyacrylonitrile; cyclic polyolefins; polyoxymethylene; polyolefinic thermoplastic elastomers; or a combination thereof.

A variety of synthetic fiber-forming polymeric materials may be employed, including thermoplastics and especially extensible thermoplastics such as linear low density polyethylenes (e.g., those available under the trade designation DOWLEX™ from Dow Chemical Company, Midland, Mich.), thermoplastic polyolefinic elastomers (TPE's, e.g., those available under the trade designations ENGAGE™ from Dow Chemical Company, Midland, Mich.; and VISTAMAXX™ from Exxon-Mobil Chemical Company, Houston, Tex.), ethylene alpha-olefin copolymers (e.g., the ethylene butene, ethylene hexene or ethylene octene copolymers available under the trade designations EXACT™ from Exxon-Mobil Chemical Company, Houston, Tex.; and ENGAGE™ from Dow Chemical Company, Midland, Mich.), ethylene vinyl acetate polymers (e.g., those available under the trade designations ELVAX™ from E.I. DuPont de Nemours & Co., Wilmington, Del.), polybutylene elastomers (e.g., those available under the trade designations CRASTIN™ from E.I. DuPont de Nemours & Co., Wilmington, Del.; and POLYBUTENE-1™ from Basell Polyolefins, Wilmington, Del.), elastomeric styrenic block copolymers (e.g., those available under the trade designations KRATON™ from Kraton Polymers, Houston, Tex.; and SOLPRENE™ from Dynasol Elastomers, Houston, Tex.) and polyether block copolyamide elastomeric materials (e.g., those available under the trade designation PEBAX™ from Arkema, Colombes, France). TPE's are especially preferred.

A variety of natural fiber-forming materials may also be made into nonwoven microfibers according to exemplary embodiments of the present disclosure. Preferred natural materials may include bitumen or pitch (e.g., for making carbon fibers). The fiber-forming material can be in molten form or carried in a suitable solvent. Reactive monomers can also be employed, and reacted with one another as they pass to or through the die. The nonwoven webs may contain a mixture of fibers in a single layer (made for example, using two closely spaced die cavities sharing a common die tip), a plurality of layers (made for example, using a plurality of die cavities arranged in a stack), or one or more layers of multi-component fibers (such as those described in U.S. Pat. No. 6,057,256, Krueger et al.).

Fibers also may be formed from blends of materials, including materials into which certain additives have been blended, such as pigments or dyes. Bi-component microfibers, such as core-sheath or side-by-side bi-component fibers, may be prepared ("bi-component" herein includes fibers with two or more components, each component occupying a part of the cross-sectional area of the fiber and extending over a substantial length of the fiber), as may be bicomponent sub-micrometer fibers. However, exemplary embodiments of the disclosure may be particularly useful and advantageous with monocomponent fibers (in which the fibers have essentially the same composition across their cross-section, but "monocomponent" includes blends or additive-containing materials, in which a continuous phase of substantially uniform composition extends across the cross-section and over the length of the fiber). Among other benefits, the ability to use single-component fibers reduces complexity of manufacturing and places fewer limitations on use of the web.

In addition to the fiber-forming materials mentioned above, various additives may be added to the fiber melt and extruded to incorporate the additive into the fiber. Typically, the amount of additives is less than about 25 weight percent, desirably, up to about 5.0 weight percent, based on a total weight of the fiber. Suitable additives include, but are not limited to, particulates, fillers, stabilizers, plasticizers, tackifiers, flow control agents, cure rate retarders, adhesion promoters (for example, silanes and titanates), adjuvants, impact modifiers, expandable microspheres, thermally conductive particles, electrically conductive particles, silica, glass, clay, talc, pigments, colorants, glass beads or bubbles, antioxidants, optical brighteners, antimicrobial agents, surfactants, fire retardants, and fluorochemicals.

One or more of the above-described additives may be used to reduce the weight and/or cost of the resulting fiber and layer, adjust viscosity, or modify the thermal properties of the fiber or confer a range of physical properties derived from the physical property activity of the additive including electrical, optical, density-related, liquid barrier or adhesive tack related properties.

3. Optional Support Layer

The composite nonwoven fibrous webs of the present disclosure may further comprise a support layer such as support layer 50 of exemplary multi-layer composite nonwoven fibrous article 40 shown in FIG. 1D. When present, the support layer may provide most of the strength of the composite nonwoven fibrous article. In some embodiments, the above-described sub-micrometer fiber component tends to have very low strength, and can be damaged during normal handling. Attachment of the sub-micrometer fiber component to a support layer lends strength to the sub-micrometer fiber component, while retaining the low Solidity and hence the desired absorbent properties of the sub-micrometer fiber component. A multi-layer composite nonwoven fibrous web structure may also provide sufficient strength for further processing, which may include, but is not limited to, winding the web into roll form, removing the web from a roll, molding, pleating, folding, stapling, weaving, and the like.

A variety of support layers may be used in the present disclosure. Suitable support layers include, but are not limited to, a nonwoven fabric, a woven fabric, a knitted fabric, a foam layer, a film, a paper layer, an adhesive-backed layer, a foil, a mesh, an elastic fabric (i.e., any of the above-described woven, knitted or nonwoven fabrics having elastic properties), an apertured web, an adhesive-backed layer, or any combination thereof. In one exemplary embodiment, the support layer comprises a polymeric nonwoven fabric. Suitable nonwoven polymeric fabrics include, but are not limited to, a spunbonded fabric, a meltblown fabric, a carded web of staple length fibers (i.e., fibers having a fiber length of less than about 100 mm), a needle-punched fabric, a split film web, a hydroentangled web, an airlaid staple fiber web, or a combination thereof. In certain exemplary embodiments, the support layer comprises a web of bonded staple fibers. As described further below, bonding may be effected using, for example, thermal bonding, adhesive bonding, powdered binder bonding, hydroentangling, needlepunching, calendering, or a combination thereof.

The support layer may have a basis weight and thickness depending upon the particular end use of the composite nonwoven fibrous article. In some embodiments of the present disclosure, it is desirable for the overall basis weight and/or thickness of the composite nonwoven fibrous article to be kept at a minimum level. In other embodiments, an overall minimum basis weight and/or thickness may be required for a given application. Typically, the support layer has a basis weight of less than about 150 gsm. In some embodiments, the support layer has a basis weight of from about 5.0 gsm to about 100 gsm. In other embodiments, the support layer has a basis weight of from about 10 gsm to about 75 gsm.

As with the basis weight, the support layer may have a thickness, which varies depending upon the particular end use of the composite nonwoven fibrous article. Typically, the support layer has a thickness of less than about 150 millimeters (mm). In some embodiments, the support layer has a thickness of from about 1.0 mm to about 35 mm. In other embodiments, the support layer has a thickness of from about 2.0 mm to about 25 mm.

In certain exemplary embodiments, the support layer may comprise a microfiber component, for example, a plurality of microfibers. In such embodiments, it may be preferred to deposit the above-described sub-micrometer fiber population directly onto the microfiber support layer to form a multi-layer composite nonwoven fibrous web. Optionally, the above-described microfiber population may deposited with or over the sub-micrometer fiber population on the microfiber support layer. In certain exemplary embodiments, the plurality of microfibers comprising the support layer are compositionally the same as the population of microfibers forming the overlayer.

The sub-micrometer fiber component may be permanently or temporarily bonded to a given support layer. In some embodiments of the present disclosure, the sub-micrometer fiber component is permanently bonded to the support layer (i.e., the sub-micrometer fiber component is attached to the support layer with the intention of being permanently bonded thereto).

In some embodiments of the present disclosure, the above-described sub-micrometer fiber component may be temporarily bonded to (i.e., removable from) a support layer, such as a release liner. In such embodiments, the sub-micrometer fiber component may be supported for a desired length of time on a temporary support layer, and optionally further processed on a temporary support layer, and subsequently permanently bonded to a second support layer.

In one exemplary embodiment of the present disclosure, the support layer comprises a spunbonded fabric comprising polypropylene fibers. In a further exemplary embodiment of the present disclosure, the support layer comprises a carded web of staple length fibers, wherein the staple length fibers comprise: (i) low-melting point or binder fibers; and (ii) high-melting point or structural fibers. Typically, the binder fibers have a melting point of at least 10° C. less than a melting point of the structural fibers, although the difference between the melting point of the binder fibers and structural fibers may be greater than 10° C. Suitable binder fibers include, but are not limited to, any of the above-mentioned polymeric fibers. Suitable structural fibers include, but are not limited to, any of the above-mentioned polymeric fibers, as well as inorganic fibers such as ceramic fibers, glass fibers, and metal fibers; and organic fibers such as cellulosic fibers.

In certain presently preferred embodiments, the support layer comprises a carded web of staple length fibers, wherein the staple length fibers comprise a blend of PET monocomponent, and PET/coPET bicomponent staple fibers. In one exemplary presently preferred embodiment, the support layer comprises a carded web of staple length fibers, wherein the staple length fibers comprise: (i) about 20 weight percent bicomponent binder fibers (e.g. INVISTA™ T254 fibers, available from Invista, Inc., Wichita, Kans.), 12 d×1.5" (about 3.81 cm); and (ii) about 80 weight percent structural fibers (e.g. INVISTA™ T293 PET fibers), 32 d×3" (about 7.62 cm).

As described above, the support layer may comprise one or more layers in combination with one another. In one exemplary embodiment, the support layer comprises a first layer, such as a nonwoven fabric or a film, and an adhesive layer on the first layer opposite the sub-micrometer fiber component. In this embodiment, the adhesive layer may cover a portion of or the entire outer surface of the first layer. The adhesive may comprise any known adhesive including pressure-sensitive adhesives, heat activatable adhesives, etc. When the adhesive layer comprises a pressure-sensitive adhesive, the composite nonwoven fibrous article may further comprise a release liner to provide temporary protection of the pressure-sensitive adhesive.

4. Optional Additional Layers

The composite nonwoven fibrous webs of the present disclosure may comprise additional layers in combination with the particulate-loaded fiber layer, the optional support layer, or both of the above (not shown in the Figures).

Suitable additional layers include, but are not limited to, a color-containing layer (e.g., a print layer); any of the above-described support layers; one or more additional sub-micrometer fiber components having a distinct average fiber diameter and/or physical composition; one or more secondary fine sub-micrometer fiber layers for additional insulation performance (such as a melt-blown web or a fiberglass fabric); foams; layers of particles; foil layers; films; decorative fabric layers; membranes (i.e., films with controlled permeability, such as dialysis membranes, reverse osmosis membranes, etc.); netting; mesh; wiring and tubing networks (i.e., layers of wires for conveying electricity or groups of tubes/pipes for conveying various fluids, such as wiring networks for heating blankets, and tubing networks for coolant flow through cooling blankets); or a combination thereof.

5. Optional Attachment Devices

In certain exemplary embodiments, the composite nonwoven fibrous webs of the present disclosure may further comprise one or more attachment devices to enable the composite nonwoven fibrous article to be attached to a substrate. As discussed above, an adhesive may be used to attach the composite nonwoven fibrous article. In addition to adhesives, other attachment devices may be used. Suitable attachment devices include, but are not limited to, any mechanical fastener such as screws, nails, clips, staples, stitching, thread, hook and loop materials, etc.

The one or more attachment devices may be used to attach the composite nonwoven fibrous article to a variety of substrates. Exemplary substrates include, but are not limited to, a vehicle component; an interior of a vehicle (i.e., the passenger compartment, the motor compartment, the trunk, etc.); a wall of a building (i.e., interior wall surface or exterior wall surface); a ceiling of a building (i.e., interior ceiling surface or exterior ceiling surface); a building material for forming a wall or ceiling of a building (e.g., a ceiling tile, wood component, gypsum board, etc.); a room partition; a metal sheet; a glass substrate; a door; a window; a machinery component; an appliance component (i.e., interior appliance surface or exterior appliance surface); a surface of a pipe or hose; a computer or electronic component; a sound recording or reproduction device; a housing or case for an appliance, computer, etc.

C. Composite Nonwoven Fibrous Web Formation Processes

Particulate-loaded composite nonwoven fibrous webs are known. Known methods for generating particulate loaded nonwoven webs generally require that the nonwoven web itself have sufficient strength and physical properties to support the combined nonwoven/particulate system. Known methods do not work well if the nonwoven web does not have sufficient strength or stiffness to support the particulates for a specific application. Fabricating a bonded particulate-loaded web may also be problematic, as it is very difficult to intermingle fibers within a bonded particulate system after the particulate system has been formed.

Certain exemplary embodiments of the present disclosure may overcome this problem by creating a composite nonwoven fibrous web in which the particulates form a substantially continuous three-dimensional network before nonwoven fibers are intermingled with the particulates to form a composite nonwoven fibrous web. In certain embodiments, such composite nonwoven fibrous webs do not rely on the physical properties of the nonwoven web to support the combined structure of the particulate-loaded nonwoven fibrous web.

By first forming a population of particulates in a substantially continuous three-dimensional network, it may be possible to avoid the problems with bonding the fibers to themselves or to the particulates. In particular fibers of very small diameter (e.g., sub-micrometer fibers) or that are weak or discontinuous by nature generally yield poorly-bound webs with little strength. Examples of processes that produce such weak webs include meltblowing, the Torobin process, and some commercial forms of air-laying.

Using particular fibers that are not very strong may also provide advantages over using stronger fibers. Sub-micrometer fibers and ultrafine microfibers, which are by their very nature weak, provide very high specific surface areas that are a benefit for applications such as filtration and insulation. Small diameter fibers (e.g., sub-micrometer fibers and ultrafine microfibers) also have a larger tendency to crush into higher density structures, largely due to their weakness. By forming a continuous particulate embedded phase dispersed throughout the finished web, the weak fibers can be supported and excessive compaction may be avoided. Lower density fine fiber webs will generally exhibit lower pressure drops than higher density webs, while still exhibiting large specific surface areas due to the unchanged diameter. This lower density structure may also minimize the amount of the particulate surface that is occluded by either the fibers or other particulates.

Thus, in another aspect, the disclosure provides a method of making a composite nonwoven fibrous web comprising forming an embedded phase having a population of particulates in a substantially continuous three-dimensional network, and forming a matrix phase comprising a population of fibers forming a three-dimensional network around the particulates.

In certain exemplary embodiments, the process for creating a composite nonwoven fibrous web according to the present disclosure may be carried out by producing a stream of particulates and combining the stream with an airborne stream of fibers. The combined stream may then be collected into a web. In some exemplary embodiments, the particulates may be bonded to the fibers during the mixing or collecting processes, or in a separate process step.

1. Formation of Particulate Network

Various methods are known for adding a stream particulates to a nonwoven fiber stream. Suitable methods are described in U.S. Pat. No. 4,118,531 (Hauser), U.S. Pat. No. 6,872,311 (Koslow), and U.S. Pat. No. 6,494,974 (Riddell); and in U.S. Patent Application Publication Nos. 2005/0266760 (Chhabra and Isele), 2005/0287891 (Park) and 2006/0096911 (Brey et al.). Applicant has discovered that by first forming a population of particulates in a substantially continuous three-dimensional network, it may be possible to avoid the problems with bonding the fibers to themselves or to the particulates when combining the particulate stream with the fiber stream. Preferably, the particulates are bonded together to form the substantially continuous three-dimensional network before embedding the particulates in a nonwoven fiber stream to form a composite nonwoven fibrous web.

In some exemplary embodiments, the particulates are bonded together to form a substantially continuous three-dimensional network before nonwoven fibers are intermingled with the particulates to form a composite nonwoven fibrous web. In certain exemplary embodiments, bonding of the particulates may be achieved using heat, pressure, solvents, adhesives, radiation (e.g., by radiation curing of a curable component of the particulates), entanglement, vibration, and the like.

In certain exemplary embodiments, a particulate density gradient may be created within the web, for example, in an axial or radial direction. Creating a particulate density gradient in an axial direction means that, along the length of the web in a direction perpendicular to the web thickness direction, the amount of particulate per square area at one end of the web differs from the amount at the other end. On the other hand, a particulate density gradient in a radial direction (e.g., when the web is wound into a generally cylindrical shape) means that the amount of particulate varies along the radial (e.g., thickness) direction of the web.

Variation of density (e.g., particulate, sorbent or fiber population concentration on a number, weight, or volume basis) need not be linear, but can vary as needed. For example, density could vary by a single step change, multiple step changes, sinusoidally, as a gradient in an axial or radial direction, as an increasing or decreasing number concentration gradient across the thickness of the web, as a number concentration gradient decreasing from a peak value proximate the centerline of the web in the thickness direction to a lower value near one or both major surfaces defining the web thickness, and the like.

2. Fiber Forming Processes

Suitable fiber streams from which to make a composite nonwoven fibrous web according to embodiments of the present disclosure include known methods of generating nonwoven fibers as well as any other method that provides an opportunity to combine the particulates, formed in a substantially continuous three-dimensional network, with a fiber stream formed during the web forming process. In certain exemplary embodiments, the fiber stream may comprise sub-micrometer fibers, microfibers, or a blend of sub-micrometer fibers and microfibers.

A number of processes may be used to produce a sub-micrometer fiber stream, including, but not limited to melt blowing, melt spinning, electrospinning, gas jet fibrillation, or combination thereof. Particularly suitable processes include, but are not limited to, processes disclosed in U.S. Pat. No. 3,874,886 (Levecque et al.), U.S. Pat. No. 4,363,646 (Torobin), U.S. Pat. No. 4,536,361 (Torobin), U.S. Pat. No. 5,227,107 (Dickenson et al.), U.S. Pat. No. 6,183,670 (Torobin), U.S. Pat. No. 6,269,513 (Torobin), U.S. Pat. No. 6,315,806 (Torobin), U.S. Pat. No. 6,743,273 (Chung et al.), U.S. Pat. No. 6,800,226 (Gerking); German Patent DE 19929709 C2 (Gerking); and Pub. PCT App. No. WO 2007/001990 A2 (Krause et al.).

Suitable processes for forming sub-micrometer fibers also include electrospinning processes, for example, those processes described in U.S. Pat. No. 1,975,504 (Formhals). Other suitable processes for forming sub-micrometer fibers are described in U.S. Pat. No. 6,114,017 (Fabbricante et al.), U.S. Pat. No. 6,382,526 B1 (Reneker et al.); and U.S. Pat. No. 6,861,025 B2 (Erickson et al.).

A number of processes may also be used to produce a microfiber stream, including, but not limited to, melt blowing, melt spinning, filament extrusion, plexifilament formation, spunbonding, wet spinning, dry spinning, or a combination thereof. Suitable processes for forming microfibers are described in U.S. Pat. No. 6,315,806 (Torobin), U.S. Pat. No. 6,114,017 (Fabbricante et al.), U.S. Pat. No. 6,382,526 B1 (Reneker et al.), and U.S. Pat. No. 6,861,025 B2 (Erickson et al.). Alternatively, a population of microfibers may be formed or converted to staple fibers and combined with a population of sub-micrometer fibers using, for example, using a process as described in U.S. Pat. No. 4,118,531 (Hauser).

In some exemplary embodiments, the method of making a composite nonwoven fibrous web comprises combining the coarse microfiber population with the fine microfiber population, the ultrafine microfiber population, or the sub-micrometer fiber population by mixing fiber streams, hydroentangling, wet forming, plexifilament formation, or a combination thereof. In combining the coarse microfiber population with the fine, ultrafine or sub-micrometer fiber populations, multiple streams of one or both types of fibers may be used, and the streams may be combined in any order. In this manner, nonwoven composite fibrous webs may be formed exhibiting various desired concentration gradients and/or layered structures.

For example, in certain exemplary embodiments, the population of fine, ultrafine or sub-micrometer fibers may be combined with the population of coarse microfibers to form an inhomogenous mixture of fibers. In certain exemplary embodiments, at least a portion of the population of fine, ultrafine or sub-micrometer fibers is intermixed with at least a portion of the population of microfibers. In other exemplary embodiments, the population of fine, ultrafine or sub-micrometer fibers may be formed as an overlayer on an underlayer comprising the population of microfibers. In certain other exemplary embodiments, the population of microfibers may be formed as an overlayer on an underlayer comprising the population of fine, ultrafine or sub-micrometer fibers.

In other exemplary embodiments, two or more fiber-forming dies may operate to form separate layers instead of forming a mixed filament airstreams. The dies could also be operating side-by-side to create a distinct layered effect as the element traverses on the rotating mandrel. Additional changes to performance could be possible by using different polymers or multicomponent fibers in one or more of the dies.

A gradient or even layered filter element may also be formed using an advancing collector mandrel by having the particle loader adding particulate to only targeted zones of the web. This can be accomplished by using a narrow particle loader in conjunction with a wider die or by using a patterned feed roll in the particle loader. The feed roll uses machined cavities to control the volumetric feed rate as the roll turns against the doctor blade. By changing the volume of the cavities across (or around) the face of the feed roller, the local-feeding of the particulates can be controlled and hence the local-added weight of particulates in the resultant web.

Another approach is to use a segmented hopper in the particle loader. The particulates are only added to the segmented regions where you want feeding to occur. This approach would also allow the use of different particles in the segmented regions to enable use of two particle sizes or have controlled addition of a treated sorbent or one having special performance. Multiple particle loaders can be used to vary the amount or type of particle loaded into the targeted region.

By using these approaches, a directly-formed composite nonwoven fibrous web may be formed that is tailored for a specific application. For example, an inner layer of fine polypropylene fibers can be formed directly adjacent to the mandrel core that will help reduce sloughing and shedding. Next to the inner layer, a middle layer of particle-loaded web for the primary separation can be provided. In addition, on the middle layer, an outer layer of desired functionality can be formed, for example, the outer layer can have greater pore size to remove larger contaminants before reaching the primary separation layer and/or have larger diameter fibers to act as an additional pre-filter layer. Many other possible arrangements could also be produced by one skilled in the art and are expected to fall within the scope of the present disclosure.

3. Optional Bonding Step

Depending on the condition of the fibers and the relative proportion of microfibers and sub-micrometer fibers, some bonding may occur between the fibers and the particulates, and between the fibers themselves, during collection. However, further bonding between the fibers and the particulates or the fibers themselves in the collected web may be desirable to provide a matrix of desired coherency, making the web more handleable and better able to hold any sub-micrometer fibers within the matrix ("bonding" fibers themselves means adhering the fibers together firmly, so they generally do not separate when the web is subjected to normal handling).

In certain exemplary embodiments, a blend of microfibers and sub-micrometer fibers may be bonded together. Bonding may be achieved, for example, using thermal bonding, adhesive bonding, powdered binder, hydroentangling, needlepunching, calendering, or a combination thereof. Conventional bonding techniques using heat and pressure applied in a point-bonding process or by smooth calender rolls can be used, though such processes may cause undesired deformation of fibers or compaction of the web. A more preferred technique for bonding fibers, particularly microfibers, is disclosed in U.S. Patent Application Publication No. 2008/0038976 A1.

4. Optional Additional Processing Steps

In addition to the foregoing methods of making and optionally bonding a composite nonwoven fibrous web, one or more of the following process steps may be carried out on the web once formed:

(1) advancing the composite nonwoven fibrous web along a process pathway toward further processing operations;

(2) bringing one or more additional layers into contact with an outer surface of the sub-micrometer fiber component, the microfiber component, and/or the optional support layer;

(3) calendering the composite nonwoven fibrous web;

(4) coating the composite nonwoven fibrous web with a surface treatment or other composition (e.g., a fire retardant composition, an adhesive composition, or a print layer);

(5) attaching the composite nonwoven fibrous web to a cardboard or plastic tube;

(6) winding-up the composite nonwoven fibrous web in the form of a roll;

(7) slitting the composite nonwoven fibrous web to form two or more slit rolls and/or a plurality of slit sheets;

(8) placing the composite nonwoven fibrous web in a mold and molding the composite nonwoven fibrous web into a new shape;

(9) applying a release liner over an exposed optional pressure-sensitive adhesive layer, when present; and

(10) attaching the composite nonwoven fibrous web to another substrate via an adhesive or any other attachment device including, but not limited to, clips, brackets, bolts/screws, nails, and straps.

3. Apparatus for Forming Composite Nonwoven Fibrous Webs

Figure 2:
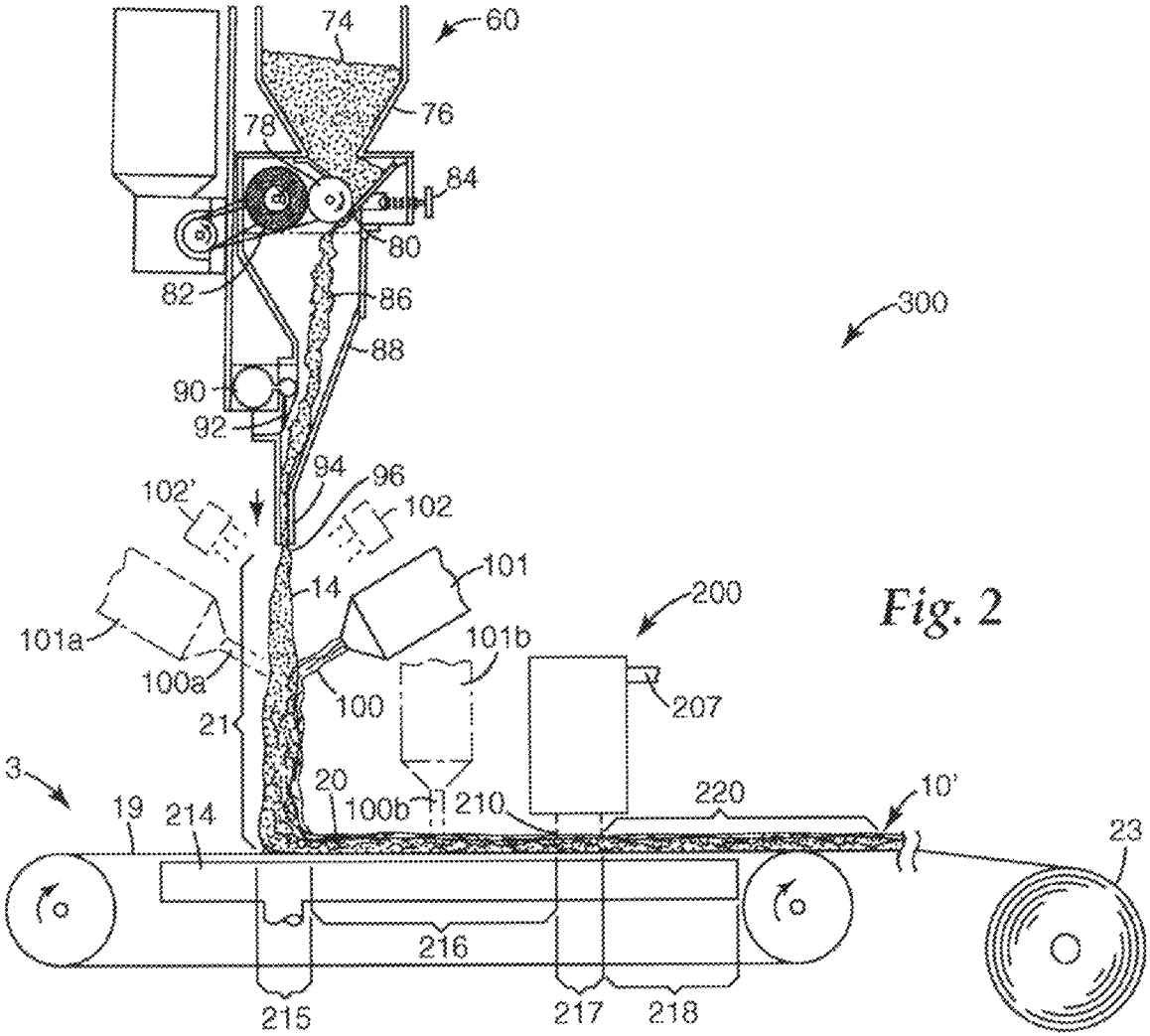
FIG. 2 is a schematic overall diagram of an illustrative apparatus for forming a composite nonwoven fibrous web comprising a substantially continuous particulate phase according to an exemplary embodiment of the disclosure.

Referring to FIG. 2, a schematic illustration of one exemplary embodiment of an apparatus 300 for making a composite nonwoven fibrous web according to the present disclosure is shown. FIG. 2 shows a particulate-loading apparatus 60 for making nonwoven particulate-loaded webs. Particulates 74 pass through hopper 76 past feed roll 78 and doctor blade 80. Motorized brush roll 82 rotates feed roll 78. Threaded adjuster 84 can be moved to improve cross-web uniformity and the rate of particulate leakage past feed roll 78. The overall particulate flow rate can be adjusted by altering the rotational rate of feed roll 78. The surface of feed roll 78 may be changed to optimize feed performance for different particulates. A cascade 86 of particulates 74 falls from feed roll 78 through chute 88, and out channel 94, forming a stream 96 of particulates 96.

The stream of particulates 96 forms a population of particulates in a substantially continuous three-dimensional network 14. In certain preferred embodiments, at least a portion of the particulates are bonded to form the substantially continuous three-dimensional network. Bonding between the particulates can be achieved, for example, using heat, pressure, solvents, adhesives, radiation, vibration, entangling, and the like. FIG. 2 illustrates one presently preferred embodiment in which the stream of particulates 96 comprises thermoplastic polymer particulates, and in which the particulates are bonded by heating to soften the particulate surfaces. Heating may be effected using any means, for example, using hot air streams emanating from optional heating elements 102 and/or 102'.

As generally illustrated in FIG. 2, a stream 100 of fibers emanating from fiber-forming apparatus 101 intercepts the stream of particulates 96. As shown in phantom lines in FIG. 2, an optional second stream 100*a* of fibers may be introduced into the stream of particulates 96 from optional fiber-forming die 101*a*. The streams merge while transiting distance 21 and become deposited on the collection apparatus 3 as a composite nonwoven fibrous web 10'.

As shown in FIG. 2, an optional third stream 100*b* of fibers may be introduced into the composite nonwoven fibrous web 10' while the web 10' is transported on a continuous screen-type collector 19 past optional fiber-forming die 101*b*. Optionally, fiber-forming die 101*b* may be used in combination with one or both of optional fiber-forming die 101*a* and/or fiber-forming die 101.

Exemplary embodiments of the present disclosure may be practiced by collecting the composite nonwoven fibrous web 10' on a continuous screen-type collector such as the belt-type collector 19 as shown in FIG. 2, on a screen-covered drum (not shown), or using alternative methods known in the art. The composite nonwoven fibrous web 10' may be wound into a roll 23.

In certain exemplary embodiments illustrated in FIG. 2, composite nonwoven fibrous web 10' may be carried by the moving collector 19 under a controlled-heating device 200 mounted above the collector 19. In the illustrative heating device 200, an elongated or knife-like stream 210 of heated air (supplied to heating device 200 through air conduit 207) is blown onto the composite nonwoven fibrous web 10' traveling on the collector 19 below the heating device 200.

Large amounts of air pass through the microfiber-forming apparatus and must be disposed of as the fibers reach the collector in the region 215. Air-exhaust device 214 preferably extends sufficiently to lie under the slot 209 of the heating device 200 (as well as extending down-web a distance 218 beyond the heated stream 210 and through an area marked 220, as will be discussed below). Sufficient air passes through the web and collector in the region 216 to hold the web in place under the various streams of processing air. Sufficient openness in the plate under the heat-treating region 217 allows treating air to pass through the web, while sufficient resistance is provided to assure that the air is evenly distributed.

To further control heating, the mass is subjected to quenching quickly after the application of the stream 210 of heated air. Such a quenching can generally be obtained by drawing ambient air over and through the composite nonwoven fibrous web 10' immediately after the mass leaves the controlled hot air stream 210. Numeral 220 in FIG. 2 represents an area in which ambient air is drawn through the web by the air-exhaust device after the web has passed through the hot air stream. An air-exhaust device (not shown) may extend along the collector for a distance 218 beyond the heating device 200 to assure thorough cooling and/or quenching of the whole composite nonwoven fibrous web 10'.

Figure 3:
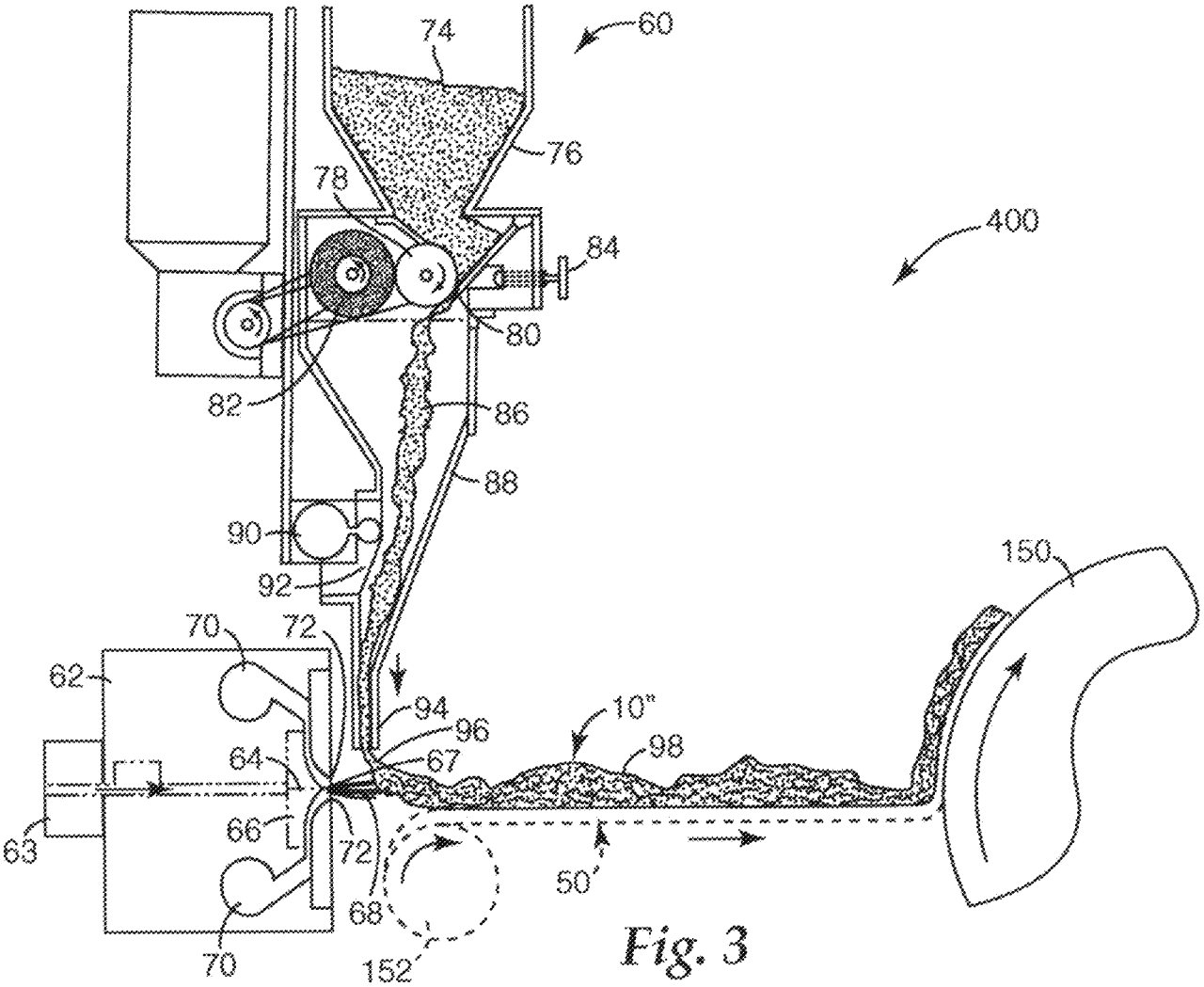
FIG. 3 is a schematic overall diagram of an illustrative apparatus for forming a composite nonwoven fibrous web comprising a substantially continuous particulate phase according to another exemplary embodiment of the disclosure.

FIG. 3 shows a schematic illustration of an alternative exemplary embodiment of an apparatus 400 for making a composite nonwoven fibrous web according to the present disclosure. FIG. 3 illustrates use of the particulate-loading apparatus 60 for making a composite nonwoven fibrous web in a meltblowing process. Molten fiber-forming polymeric material enters nonwoven die 62 via inlet 63, flows through die slot 64 of die cavity 66 (all shown in phantom), and exits die cavity 66 through orifices such as orifice 67 as a series of filaments 68. An attenuating fluid (typically air) conducted through air manifolds 70 attenuates filaments 68 into fibers 98 at die exit 72.

Meanwhile, particulates 74 pass through hopper 76 past feed roll 78 and doctor blade 80. Motorized brush roll 82 rotates feed roll 78. Threaded adjuster 84 can be moved to improve cross-web uniformity and the rate of particulate leakage past feed roll 78. The overall particulate flow rate can be adjusted by altering the rotational rate of feed roll 78. The surface of feed roll 78 may be changed to optimize feed performance for different particulates. A cascade 86 of particulates 74 falls from feed roll 78 through chute 88. Air or other fluid passes through manifold 90 and cavity 92 and directs the falling particulates 74 through channel 94 in a stream 96 amidst filaments 68 and fibers 98 of the polymeric material. The mixture of particulates 74 and fibers 98 forms a self-supporting composite nonwoven fibrous web 10", and lands against porous collector 150. Optionally, optional support layer 50 may be fed from optional roll 152 and used to collect and support composite nonwoven fibrous web 10".

Figure 4:
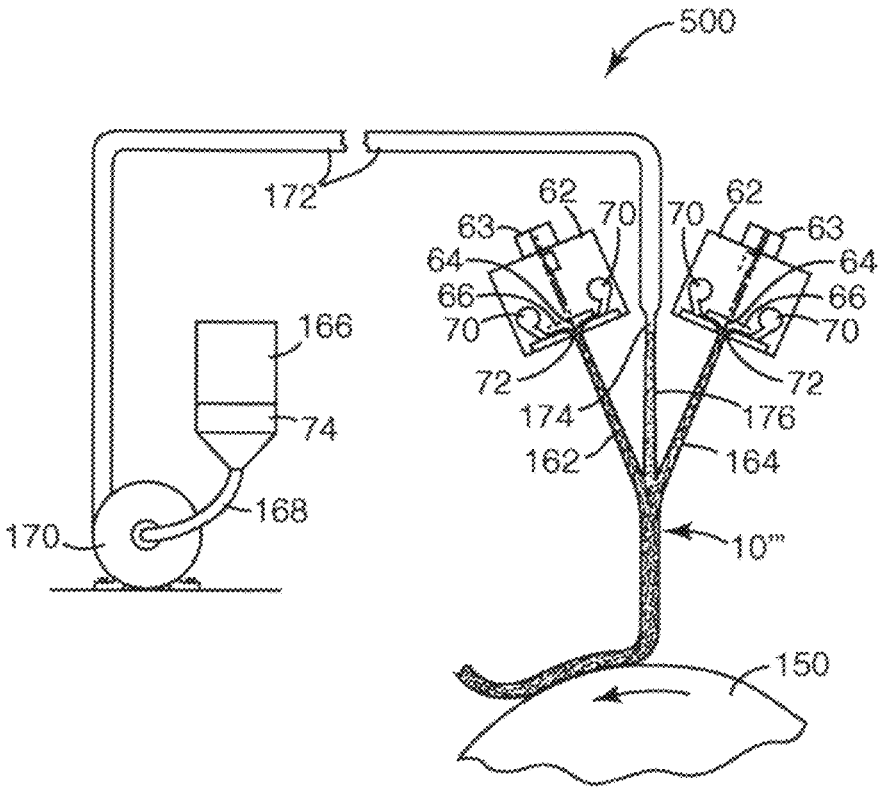
FIG. 4 is a schematic overall diagram of an illustrative apparatus for forming a composite nonwoven fibrous web comprising a substantially continuous particulate phase according to a further exemplary embodiment of the disclosure

FIG. 4 illustrates another exemplary embodiment of an apparatus 500 for making a composite nonwoven fibrous web according to the present disclosure. FIG. 4 illustrates use of the particulate-loading apparatus 60 for making a composite nonwoven fibrous web in an alternative meltblowing fiber formation process.

As generally illustrated in FIG. 4, the exemplary apparatus 500 employs two generally vertical, obliquely-disposed meltblowing dies 66 that project generally opposing streams of meltblown fibers 162, 164 toward collector 100. Meanwhile, particulates 74 pass through hopper 166 and into conduit 168. Air impeller 170 forces air through a second conduit 172 and accordingly draws particulates from conduit 168 into the second conduit 172. The particulates are ejected through nozzle 174 as a cohesive particulate stream 176, which combines with the streams of meltblown fibers 162 and 164. The particulate stream 176 and streams of meltblown fibers 162 and 164 form a self-supporting nonwoven web 10''', and lands against porous collector 150. Further details regarding the manner in which meltblowing would be carried out using the FIG. 4 apparatus will be familiar to those skilled in the art.

D. Methods of Using Composite Nonwoven Fibrous Webs

The present disclosure is also directed to methods of using the composite nonwoven fibrous webs of the present disclosure in a variety of absorption applications. In exemplary embodiments, the article may be used as a gas filtration article, a liquid filtration article, a sound absorption article, a surface cleaning article, a cellular growth support article, a drug delivery article, a personal hygiene article, or a wound dressing article.

In certain exemplary gas filtration applications, webs such as described herein may provide much improved particle capture without excessive pressure drop. The particulates themselves can be active to capturing target species or aerosols from the air. By taking advantage of the lower fiber density such a system would have lower pressure drop than a highly packed fine fiber layer. The fibers and the particulates could also be potentially charged as electrets, providing additional particulate capture performance.

In addition, low Solidity composite nonwoven fibrous webs according to certain exemplary embodiments of the present disclosure may be advantageous in gas filtration applications due to the reduced pressure drop that results from lower Solidity. Decreasing the Solidity of a fiber web will generally reduce its pressure drop. Lower pressure drop increase upon particulate loading of low Solidity sub-micrometer composite nonwoven fibrous web of the present disclosure may also result. Current methods for forming particulate-loaded sub-micrometer fibers results in much higher pressure drop than for coarser microfiber webs, partially due to the higher Solidity of the fine sub-micrometer fiber webs.

In addition, the use of sub-micrometer fibers in gas filtration may be particularly advantageous due to the improved particulate capture efficiency that sub-micrometer fibers may provide. In particular, sub-micrometer fibers may capture small diameter airborne particulates better than coarser fibers. For example, sub-micrometer fibers may more efficiently capture airborne particulates having a dimension smaller than about 1000 nanometers (nm), more preferably smaller than about 500 nm, even more preferably smaller than about 100 nm, and most preferably below about 50 nm. Gas filters such as this may be particularly useful in personal protection respirators; heating, ventilation and air conditioning (HVAC) filters; automotive air filters (e.g., automotive engine air cleaners, automotive exhaust gas filtration, automotive passenger compartment air filtration); and other gas-particulate filtration applications.

Liquid filters containing sub-micrometer fibers with low Solidity in the form of certain exemplary composite nonwoven fibrous webs of the present disclosure may also have the advantage of improved depth loading while maintaining small pore size for capture of sub-micrometer, liquid-borne particulates. These properties improve the loading performance of the filter by allowing the filter to capture more of the challenge particulates without plugging.

In addition, for certain liquid filtration applications, the continuous particulate phase may allow for a defined pore structure, thereby providing depth filtration functionality. Furthermore, the higher fiber and/or particulate surface area may be used to promote chemical binding or reaction with the filter. The particulate phase may also act to prevent the crushing of the filter due to handling, processing, or use.

Certain exemplary composite nonwoven fibrous webs of the present disclosure may also have usefulness as a thermal or acoustic insulation material. Use of the web as a thermal insulation material could advantageously exploit the low fiber density provided by certain embodiments of this disclosure. Lower fiber density may allow the insulation to trap more stagnant air, reducing thermal conductivity. The increased surface area of the fine fibers may also be useful for the attenuation and absorption of sound. Particulates that may be useful in such embodiments include, but are not limited to, phase-change materials, odor absorbents, and aerogels.

The low density composite nonwoven fibrous webs according to certain exemplary embodiments of the present disclosure may also be useful in a wipe for surface cleaning, for example, in personal hygiene and cleaning applications. The low density structure may allow for better fluid control, while the particulates could be selected to provide properties such as absorbency, anti-microbial properties, or odor control. The low density structure also provides a better opportunity for dirt, soil, and debris to be trapped within the fabric when used as a wipe. The structure provided by the low Solidity composite nonwoven fibrous webs of certain exemplary embodiments may also be effective in providing a soft wipe, while low Solidity may provide the advantage of providing a reservoir for cleaning agents and high pore volume for trapping debris.

A low Solidity sub-micrometer fiber-containing composite nonwoven fibrous web of some exemplary embodiments of the present disclosure may also be a preferred substrate for supporting a membrane. The low Solidity fine web could act a both a physical support for the membrane, but also as a depth pre-filter, enhancing the life of the membrane. The use of such a system could act as a highly effective symmetric or asymmetric membrane. Applications for such membranes include ion-rejection, ultrafiltration, reverse osmosis, selective binding and/or adsorption, and fuel cell transport and reaction systems.

Low Solidity sub-micrometer composite nonwoven fibrous webs of some particular embodiments of the present disclosure may also be useful synthetic matrices for promoting cellular growth. The open structure with fine sub-micrometer fibers may mimic naturally occurring systems and promotes more in vivo-like behavior. This is in contrast to current products (such as Donaldson Ultra-Web™ Synthetic ECM, available from Donaldson Corp., Minneapolis, Minn.) where high Solidity fiber webs act as a synthetic basement membrane, with little or no penetration of cells within the fiber matrix.

A low Solidity particle-loaded sub-micrometer fiber web according to certain exemplary embodiments of the present disclosure may also be useful to promote the growth of cells within the nonwoven web. Having sufficiently fine fibers may allow the cells to utilize the fibers as a synthetic matrix, while the particulates could act to supply nutrients, bioactive compounds, anti-microbial formulations, and the like. If the nonwoven web had too high of a Solidity, target cells could not grow within the fiber matrix, potentially resulting in different cellular behavior.

In some applications, nonwoven composite fibrous webs according to certain exemplary embodiments of the present disclosure may be useful for drug delivery and/or wound dressing. For example, the particulates could be selected to be a drug for delivery to a wound for treatment.

A composite nonwoven fibrous web as described may also have a number of beneficial and unique processing advantages in certain exemplary embodiments. For example, in certain exemplary embodiments, a useful finished product may be prepared that consists only of a single layer, but comprises a mixture of particulates and fibers, which may comprise microfibers, ultrafine microfibers, and/or sub-micrometer fibers. Such a single-layer web may offer important fabrication efficiencies; for example, product complexity and waste may be reduced by eliminating laminating processes and equipment and by reducing the number of intermediate materials. Given the direct-web-formation nature of manufacturing webs of the certain exemplary embodiments of the present invention, in which a fiber-forming polymeric material is converted into a web in one essentially direct operation, webs of certain exemplary embodiments of the present invention may be quite economical. Also, if the fibers of the web all comprise the same polymeric composition, the web can be fully recyclable.

In addition, a composite nonwoven fibrous web of certain exemplary embodiments of the present invention may be used to produce a multi-layer product, and also may be used in a variety of physical forms. For example, it may be molded or pleated, as well as being used in its collected web form. By using fibers of very small diameter (e.g., ultrafine microfibers and/or sub-micrometer fibers), which is made possible in certain exemplary embodiments of the present invention, the web may be provided with greatly increased fiber surface area, with such beneficial effects as improved filtration and thermal or acoustic insulating performance. Absorbency in fluid filtration and acoustic absorption may, in some embodiments, be tailored to a particular use by using fibers of different diameters. Pressure drop through the composite nonwoven fibrous web may also be lower.

In certain exemplary embodiments, composite nonwoven fibrous webs according to the present disclosure disclosed porous sheet materials may be used to capture or adsorb a wide variety of chemical materials, including organic solvents, inorganic vapors and other materials that will be familiar to those skilled in the art.

As will be familiar to those skilled in the art, one or more additional layers such as cover web(s), stiffening layer(s), particulate filtration layer(s) such as charged nonwoven webs or other functional or decorative layers may also be employed. The disclosed composite nonwoven fibrous webs may be especially useful for fabricating replaceable cartridges for personal respirators intended for use in solvent-containing atmospheres. However, the disclosed composite nonwoven fibrous webs may have a variety of additional uses.

For example, exemplary composite nonwoven fibrous web may be employed in personal or collective protective equipment such as chemical protective suits, hoods, individual enclosures (e.g., isolation chambers), shelters (e.g., tents or other portable or permanent structures) and other personal or collective protection devices into which air is filtered through the porous sheet article. The disclosed webs may also be supported by a suitable housing to provide a filter for conditioning the gases entering into or circulating in an enclosed area such as a building or vehicle. The disclosed webs may also be used to provide a prefilter or postfilter that can be combined with a further (e.g., an existing) filter structure. Additional uses will be familiar to those skilled in the art.

EXAMPLES

Exemplary embodiments of the present invention have been described above and are further illustrated below by way of the following Examples, which are not to be construed in any way as imposing limitations upon the scope of the present invention. On the contrary, it is to be clearly understood that resort may be had to various other embodiments, modifications, and equivalents thereof which, after reading the description herein, may suggest themselves to those skilled in the art without departing from the spirit of the present disclosure and/or the scope of the appended claims. Furthermore, notwithstanding that the numerical ranges and parameters setting forth the broad scope of the disclosure are approximations, the numerical values set forth in the specific examples are reported as precisely as possible. Any numerical value, however, inherently contain certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Fabrication of Composite Nonwoven Fibrous Webs Having Continuous Particulate Phase Exemplary composite webs were made by combining various particulate streams with a fiber stream from the process described in U.S. Pat. No. 4,536,361. The process was configured such that the fiber forming die was aimed at an angle of approximately 45 degrees below the horizon, towards a horizontal vacuum collector. The particulates were shaken out of a tray above the fiber die such that the particulate stream fell vertically into the fiber stream. The composite web was collected on the vacuum collector and wound up from the collector belt. No additional bonding was done after the web was formed on the collector belt.

The fiber process used grade 3960 polypropylene from Total Petrochemicals, Houston, Tex. The polymer was melted using a ¾" diameter single screw extruder and fed to the sub-micron fiber forming die. The die was heated to 290° C., and was fed with polymer at a rate of 7 grams per minute. Room temperature air was fed to the die at a pressure of 80 pounds per square inch. The fiber process conditions were held constant for all samples.

The particulates used were:

Sample A: No particulate, control sample;

Sample B: Maxi-blast thermoset blasting media from Maxi-Blast Incorporated, South Bend, Ind.;

Sample C: 12×20 grid activated carbon, type GG from Kuraray Chemical Company, Ltd., Japan;

Sample D: 80×325 mesh activated carbon, type CC from PICA USA Inc., Columbus, Ohio;

Sample E: 240 grit alumina abrasive powder.

The median fiber diameter of Sample A was measured using scanning electron microscopy; Sample A had a median fiber diameter of 0.86 micrometers. The basis weight of each sample was measured and the results are reported in Table I.

TABLE I

| Sample | Total Basis Weight (gsm) | Fiber Mass Fraction (%) |
|---|---|---|
| Sample A | 50.4 | 100 |
| Sample B | 151 | 33 |
| Sample C | 998 | 5.1 |
| Sample D | 275 | 18 |
| Sample E | 428 | 12 |

The fiber mass fraction, calculated from the basis weight of the fibers in each sample, was maintained nearly constant across all samples.

The thickness of each sample was measured as a function of the applied pressure as a measure of the crush resistance of the particulate loaded web samples. Pressures of 15, 30, 60, 120, 150, and 225 Pascals were used and the web thickness was measured in mils (one mil corresponding to 25 micrometers). The crush resistance results were expressed as the ratio of the measured web thickness at a given applied pressure to the web thickness at 15 Pa pressure, and were thus normalized to 100%. The measured thicknesses and crush resistance as a function of the applied pressure results are shown in Table II. All of the particulate loaded composite webs show improved compression resistance compared to the control web.

TABLE II

| | Sample A - Control | | Sample B - Maxiblast | | Sample C - 12 × 20 Carbon | | Sample D - 80 × 325 Carbon | | Sample E - 240 grit Alumina | |
|---|---|---|---|---|---|---|---|---|---|---|
| Pressure Pa | Thickness mil | Normalized % | Thickness mil | Normalized % | Thickness mil | Normalized % | Thickness mil | Normalized % | Thickness mil | Normalized % |
| 15 | 41 | 100.00 | 74 | 100.00 | 322 | 100.00 | 102.5 | 100.00 | 77.5 | 100.00 |
| 30 | 39 | 95.12 | 71.5 | 96.62 | 317.5 | 98.60 | 98.5 | 96.10 | 74 | 95.48 |
| 60 | 37 | 90.24 | 68 | 91.89 | 309 | 95.96 | 93.5 | 91.22 | 70.5 | 90.97 |
| 120 | 34.5 | 84.15 | 63 | 85.14 | 299 | 92.86 | Sample lost to error | | 67 | 86.45 |
| 150 | 32.5 | 79.27 | 60.5 | 81.76 | 292.5 | 90.84 | 83.5 | 81.46 | 65 | 83.87 |
| 225 | 31.5 | 76.83 | 57.5 | 77.70 | 282 | 87.58 | 81 | 79.02 | 60.5 | 78.06 |

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present invention. Thus, the appearances of the phrases such as "in one or more embodiments," "in certain embodiments," "in one embodiment" or "in an embodiment" in various places throughout this specification are not necessarily referring to the same embodiment of the certain exemplary embodiments of the present invention. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g. 1 to 5 includes 1, 1.5, 2, 2.75, 3, 3.80, 4, and 5). In addition, all numbers used herein are assumed to be modified by the term 'about'. Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

The invention claimed is:

1. A composite nonwoven fibrous web comprising:

an embedded phase of particulates forming a substantially continuous three-dimensional network of particulates, wherein all of the particulates in the embedded phase collectively make-up a population of particulates including all particulates in the nonwoven fibrous web, wherein each individual particulate of the population of particulates of the embedded phase is in surface to surface contact with at least one other particulate of the population of particulates of the embedded phase, further wherein each individual particulate of the population of particulates of the embedded phase is inorganic; and a matrix phase comprising a population of fibers forming a three-dimensional network around the embedded phase, wherein the composite nonwoven fibrous web has a thickness and exhibits a Solidity of less than 10%.

2. The web of claim 1, wherein the population of particulates comprises an absorbent, an adsorbent, activated carbon, an anion exchange resin, a cation exchange resin, a molecular sieve, or a combination thereof.

3. The web of claim 1, wherein the population of particulates has a median diameter of at least one micrometer (μm).

4. The web of claim 1, wherein the population of particulates has a median diameter of less than 1 μm.

5. The web of claim 1, wherein the population of fibers is oriented wherein there is molecular orientation within the fiber.

6. The web of claim 1, wherein the population of fibers has a median diameter less than 1 μm, optionally wherein the population of fibers has a median fiber diameter ranging from about 0.2 μm to about 0.9 μm.

7. The web of claim 1, wherein the population of fibers has a median diameter of at least 1 μm, optionally wherein the population of fibers has a median fiber diameter ranging from about 2 μm to about 50 μm.

8. The web of claim 1, wherein the population of fibers comprises polymeric fibers, optionally wherein the polymeric fibers comprise polypropylene, polyethylene, polyester, polyethylene terephthalate, polybutylene terephthalate, polyamide, polyurethane, polybutene, polylactic acid, polyvinyl alcohol, polyphenylene sulfide, polysulfone, liquid crystalline polymer, polyethylene-co-vinylacetate, polyacrylonitril, cyclic polyolefin, polyoxymethylene, polyolefinic thermoplastic elastomers, or a combination thereof.

9. The web of claim 1, wherein at least a portion of the population of particulates are bonded to at least a portion of the separately formed fibers.

10. The web of claim 1, wherein the population of fibers forming a three-dimensional network around the particulates comprises sub-micrometer fibers, wherein the matrix phase further comprises a population of microfibers, and further wherein a ratio of the number of sub-micrometer fibers to the number of microfibers varies across the thickness of the composite nonwoven fibrous web, optionally wherein the ratio of the number of sub-micrometer fibers to the number of microfibers decreases across the thickness of the composite nonwoven fibrous web.

11. The web of claim 10, wherein the ratio of the number of sub-micrometer fibers to the number of microfibers varies from a peak value proximate a centerline defined by the half-thickness of the composite nonwoven fibrous web, to a lower value at a surface of the composite nonwoven fibrous web.

12. The web of claim 1, further comprising a support layer, optionally wherein the support layer comprises a nonwoven fabric, a woven fabric, a knitted fabric, a foam layer, a film, a paper layer, an adhesive-backed layer, or a combination thereof.

13. The web of claim 12, wherein the support layer comprises a polymeric nonwoven fabric.

14. The web of claim 12, wherein the support layer comprises a web of bonded staple fibers, further wherein the support layer is bonded using thermal bonding, adhesive bonding, powdered binder, hydroentangling, needlepunching, calendering, or a combination thereof.

15. A method of making a composite nonwoven fibrous web comprising:

a. forming an embedded phase of particulates including all particulates in the composite nonwoven fibrous web, wherein all of the particulates in the embedded phase collectively make-up a population of particulates in a substantially continuous three-dimensional network in which each individual particulate of the embedded phase is in surface to surface contact with at least one other particulate of the embedded phase, wherein each individual particulate of the embedded phase is inorganic; and b. forming a matrix phase comprising a population of fibers forming a three-dimensional network around the embedded phase, wherein the composite nonwoven fibrous web has a thickness and exhibits a Solidity of less than 10%.

16. The method of claim 15, wherein the population of particulates comprises an absorbent, an adsorbent, activated carbon, an anion exchange resin, a cation exchange resin, a molecular sieve, or a combination thereof.

17. The method of claim 15, wherein at least a portion of the population of particulates are bonded to at least a portion of the separately formed fibers.

18. The method of claim 15, wherein the population of fibers forming a three-dimensional network around the particulates comprises sub-micrometer fibers, wherein the matrix phase further comprises a population of microfibers, optionally wherein the population of microfibers is formed separately from the population of sub-micrometer fibers.

19. An article comprising the composite nonwoven fibrous web prepared according to the method of claim 15, selected from the group consisting of a gas filtration article, a liquid filtration article, a sound absorption article, a surface cleaning article, a cellular growth support article, a drug delivery article, a personal hygiene article, and a wound dressing article.

* * * * *